US007334408B2

(12) United States Patent
Bethke et al.

(10) Patent No.: US 7,334,408 B2
(45) Date of Patent: Feb. 26, 2008

(54) COMBUSTION CHAMBER FOR A GAS TURBINE WITH AT LEAST TWO RESONATOR DEVICES

(75) Inventors: Sven Bethke, Düsseldorf (DE); Tobias Buchal, Düsseldorf (DE); Michael Huth, Essen (DE); Harald Nimptsch, Essen (DE); Bernd Prade, Mulheim (DE); John Carl Glessner, Oviedo, FL (US)

(73) Assignee: Siemens Aktiengesellschaft, Munich (DE)

( * ) Notice: Subject to any disclaimer, the term of this patent is extended or adjusted under 35 U.S.C. 154(b) by 187 days.

(21) Appl. No.: 10/946,457

(22) Filed: Sep. 21, 2004

(65) Prior Publication Data

US 2006/0059913 A1 Mar. 23, 2006

(51) Int. Cl.
*F02C 7/24* (2006.01)

(52) U.S. Cl. ..... 60/725; 181/213; 431/114

(58) Field of Classification Search ..... 60/725, 60/752; 181/213; 431/114
See application file for complete search history.

(56) References Cited

U.S. PATENT DOCUMENTS 5,373,695 A * 12/1994 Aigner et al. ..... 60/725
5,685,157 A * 11/1997 Pandalai et al. ..... 60/725
6,351,947 B1 3/2002 Keller et al.
6,546,729 B2 * 4/2003 Hellat et al. ..... 60/725
7,194,862 B2 * 3/2007 Sattinger ..... 60/725

FOREIGN PATENT DOCUMENTS

| | | |
|---|---|---|
| DE | 33 24 805 A1 | 1/1985 |
| DE | 196 40 980 A1 | 4/1998 |
| EP | 0 702 141 A2 | 3/1996 |
| EP | 1 213 539 A1 | 6/2002 |
| EP | 1 434 006 A2 | 6/2004 |
| EP | 1 568 869 A1 | 8/2005 |
| WO | WO 03/023281 A1 | 3/2003 |
| WO | WO 2004/051063 A1 | 6/2004 |

* cited by examiner

*Primary Examiner*—L. J. Casaregola

(57) ABSTRACT

A combustion chamber according to the invention, in particular for a gas turbine, includes at least one combustion chamber wall through which cooling fluid flows and at least one resonator device. The combustion chamber according to the invention is distinguished in that the resonator device is integrated into the combustion chamber wall in such a way that it has the cooling fluid flow passing there through.

9 Claims, 1 Drawing Sheet

COMBUSTION CHAMBER FOR A GAS TURBINE WITH AT LEAST TWO RESONATOR DEVICES

FIELD OF THE INVENTION

The present invention concerns a gas turbine with at least a combustion chamber and at least two resonator devices for damping acoustic oscillations in the combustion chamber.

BACKGROUND OF THE INVENTION

A gas turbine plant includes for example a compressor and a combustion chamber, as well as a turbine. The compressor provides for compressing intake air with which a fuel is then mixed. Combustion of the mixture takes place in the combustion chamber, with the combustion exhaust gases being passed to the turbine. There, heat energy is taken from the combustion exhaust gases and converted into mechanical energy.

Fluctuations in the quality of the fuel and other thermal or acoustic disturbances however result in fluctuations in the amount of heat liberated and thus the thermodynamic efficiency of the plant. In that situation, there is an interaction of acoustic and thermal disturbances which can push themselves up. Thermo-acoustic oscillations of that nature in the combustion chambers of gas turbines—or also combustion machines in general—represent a problem in terms of designing and operating new combustion chambers, combustion chamber parts and burners for gas turbines or combustion machines.

The exhaust gases produced in the combustion process are at a high temperature. They are therefore diluted with cooling air in order to reduce the temperature to a level which is tenable for the combustion chamber wall and the turbine components. The cooling air passes into the combustion chamber through cooling air openings in the combustion chamber wall. In addition so-called seal air passes into the combustion chamber, that is to say, air which serves to prevent the entry of hot gas from the combustion chamber into gaps between adjacent elements of a heat-protective lining of the combustion chamber. In that case the seal air is blown through the gaps between adjacent elements of the heat-protective lining into the combustion chamber.

Diluting the combustion gases with cooling and seal air however results in a higher level of pollutant emissions. In order to reduce the pollutant emissions of gas turbines, the cooling and seal air flows are therefore kept low in modern plants. As a result however that also reduces the acoustic damping effect so that thermo-acoustic oscillations can increase. That can involve a mutually increasing interaction between thermal and acoustic disturbances which can cause high levels of stress and loading for the combustion chamber and increasing emissions.

Therefore, in the state of the art, for the purposes of reducing thermo-acoustic oscillations, for example Helmholtz resonators are used for damping thermo-acoustic oscillations in combustion chambers of gas turbines, which damp the amplitude of the oscillations.

In order to be able to damp the thermo-acoustic oscillations in a greater frequency range, DE 33 24 805 A1 proposed using a plurality of Helmholtz resonators involving different resonance frequencies, which are arranged laterally at the air passage to the combustion chamber. In that case each Helmholtz resonator damps different frequencies of the acoustic oscillations. It will be noted that cooling air has to be additionally used. That either increases the cooling air consumption, or it means that less cooling air is available for cooling the combustion exhaust gases, whereby there is an increase in the proportion of pollutants in the combustion exhaust gases.

Therefore there is a need for a combustion chamber and a gas turbine in which the arrangement of different damping devices is such that the additional cooling air requirement can remain relatively low.

SUMMARY OF THE INVENTION

A combustion chamber according to the invention, in particular for a gas turbine, includes at least one combustion chamber wall through which flows cooling fluid, in particular cooling air, and at least one resonator device. In this respect the term resonator device is used to denote a damping device for damping acoustic oscillations which includes at least one Helmholtz resonator. The combustion chamber according to the invention is distinguished in that the resonator device is integrated into the combustion chamber wall in such a way that it has the cooling fluid flow flowing through.

In the combustion chamber according to the invention, the fact that the resonator device is integrated into the chamber wall of the combustion chamber and has the flow of cooling fluid flowing through provides that the cooling fluid flow which is used for cooling the resonator device is also still available for cooling the chamber wall and/or for sealing gaps and/or for diluting the combustion exhaust gases. In that way the pollutant content in the combustion exhaust gases can be kept at a low level and at the same time the effects of thermo-acoustic oscillations can be effectively reduced by means of the resonator device.

Preferably the combustion chamber has at least two resonator devices with different resonance frequencies. At least one resonator device can be in the form of a high frequency damping device and at least one resonator device can be in the form of a medium frequency damping device.

In that case, in accordance with this application, the term high frequency is preferably used to denote the range from about 250 Hertz, in particular from about 500 Hertz. The term medium frequency or medium frequency range is preferably used to denote the range between about 30 and 750 Hertz, in particular between 50 and 500 Hertz. However, deviations by up to 50% of the specified values and ranges are also possible.

Division into two frequency bands, wherein oscillations in the various frequency bands are damped by the different resonator devices, permits an effective reduction in the oscillations which occur. The frequency bands can overlap, in particular at the edges, but do not have to do so. In addition it is also possible to use three or more different frequency bands, that is to say three or more resonator devices, which respectively differ from each other in respect of their resonance frequencies.

The resonator devices are preferably integrated into the combustion chamber wall in such a way that they each have partial flows of the cooling fluid flow passing through. In that case, the resonator devices can be integrated into the combustion chamber wall in such a way that either they form parallel flow paths for the partial flows of the cooling fluid flow, they form flow paths which are connected in succession for the partial flows of the cooling fluid flow, or they form both parallel flow paths and also flow paths which are connected in succession, for the partial flows of the cooling fluid flow. It is in that way that the flow conditions in the individual resonator devices—and thus the conditions prevailing in the resonator devices—can be specifically and targetedly adjusted.

The cooling fluid flow can have in particular regions involving different pressures. In the resonator devices which each have at least one entry as a flow inlet and at least one exit as a flow outlet, the entries and/or the exits of resonator devices with a first resonance frequency can then be connected to a different pressure level than the entries or exits of resonator devices with a second resonance frequency which is different from the first one. By selecting suitable pressures for the respective entries and exits of the resonator devices, it is possible to specifically and targetedly adjust the flow conditions in the individual resonator devices—and thus the general conditions prevailing in the resonator devices.

Preferably the flow through the resonator devices is connected in parallel relationship with the flow through an inlet valve for inlet of the fluid into the combustion chamber.

A gas turbine according to the invention includes at least one combustion chamber according to the invention.

Although the invention is described herein generally in relation to gas turbines, the use thereof is not limited to gas turbines. It is also possible for the invention to be used in relation to other turbines and combustion machines.

BRIEF DESCRIPTION OF THE DRAWING

Further features, properties and advantages of the present invention will become apparent from the description hereinafter of the embodiment by way of example with reference to the accompanying drawing.

DETAILED DESCRIPTION OF THE PREFERRED EMBODIMENTS

Figure 1:
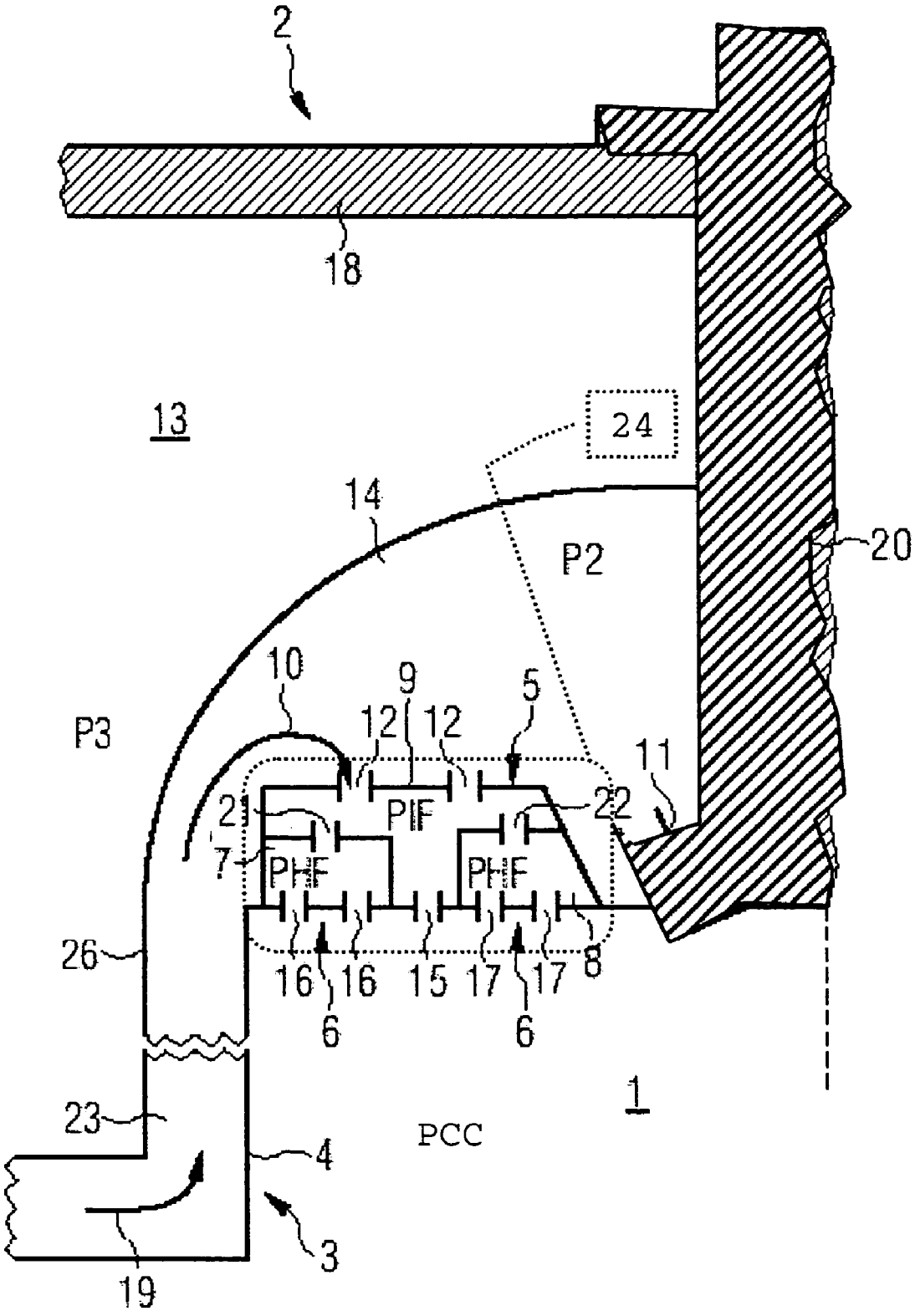
FIG. 1 is a diagrammatic view of an embodiment of a combustion chamber according to the invention.

FIG. 1 diagrammatically shows a portion from the head plate 24 of a combustion chamber 1 of a gas turbine 2, as an embodiment by way of example of a combustion chamber according to the invention. The gas turbine 2 includes an outer casing 18 which surrounds the combustion chamber 1. Provided at the combustion chamber 1 is a burner 20 of which only a portion is illustrated in the Figure and at the sides of which are arranged air inlet valves 25 for the feed of air for the combustion process (only one of the air inlet valves 25 can be seen in FIG. 1). The air is passed through the chamber wall 3 to the air inlet valves 25. The chamber wall 3 includes a rear chamber wall 26 and a lining 4 which forms a front chamber wall. The intermediate space 23 between the rear chamber wall 26 and the lining 4 in that arrangement forms at least one flow passage for the feed of air to the air inlet valves 25. The air flowing through the flow passage is not intended exclusively for the combustion process but also serves as cooling air for cooling the lining 4 and/or optionally as seal air for blocking gaps between adjacent elements of the lining 4.

Associated with the combustion chamber 1 are resonator devices 5, 6 for damping thermo-acoustic oscillations, which are integrated in the region of the head plate 24 into the chamber wall 3 of the combustion chamber 1, in particular into the lining 4. In that respect a resonator device 5 serves for damping thermo-acoustic oscillations in the medium frequency range and includes a Helmholtz resonator 9, referred to hereinafter as the IF-resonator. The other resonator device 6 serves for damping thermo-acoustic oscillations in the high frequency range and includes two Helmholtz resonators 7, 8, referred to hereinafter as the HF-resonator. Although only two resonator devices 5, 6 are illustrated in FIG. 1, the combustion chamber 1 may also include further resonator devices. In addition the Helmholtz resonators do not necessarily need to be arranged in the head plate of a combustion chamber. For example, in an annular combustion chamber, a plurality of resonator devices 5, 6 can be distributed over the periphery of the chamber wall 3. They can also differ in respect of their resonance frequencies from the resonator devices 5, 6 shown in FIG. 1.

The resonators 7, 8, 9 are arranged in the cooling air flow and/or in the seal air flow. The Helmholtz resonators 7, 8, 9 each have a respective resonator volume as well as at least one entry 12, 21, 22 as a flow inlet and at least one exit 15, 16, 17, 21, 22 as a flow outlet, the flow diameters of the inlet and the outlet being smaller than the flow diameter of the resonator volume. Due to the portions, through which the air flow passes, of differing flow cross-section, imposed on the flow is a resonance oscillation which provides for damping of the thermo-acoustic oscillations. The resonance frequency and therewith the frequency in respect of which damping of the thermo-acoustic oscillations is at the most effective depends on the magnitude of the resonator volume.

The entries 21, 22 of the HF-resonators 7, 8 are at the same time exits of the IF-resonator 9. A further exit 15 of the IF-resonator 9 and the exits 16, 17 of the HF-resonators 7, 8 lead to the combustion chamber 1 of the gas turbine 2 where they serve as cooling and/or seal air outlets.

The air flow occurs from the compressor plenum 13 in which a pressure P3 is present into the intermediate space 23 between the lining 4 and the rear wall 26 and there along the flow path 19. On that occasion the lining 4 of the combustion chamber wall 3 is cooled by the flowing air. The air which is passed on then enters the burner plenum 14, the pressure being reduced to the pressure P2.

From the burner plenum 14 the main part of the air flow goes along the flow path 11 through the air inlet valve 25 into the combustion chamber 1. In parallel therewith a part of the air flow goes along the flow path 10 through the entries 12 into the IF-resonator 9 where there is a pressure PIF which is lower than the pressure P2 in the burner plenum 14. A part of that air flow then flows out of the IF-resonator 9 through the exit 15 directly into the combustion chamber 1 in which a pressure PCC obtains, while another part flows through the exits 21, 22 into the HF-resonators 7, 8 in which there obtains a pressure PHF which is lower than the pressure PIF in the IF-resonator 9 and higher than the pressure PCC in the combustion chamber 1. The exits 21, 22 of the IF-resonator serve at the same time as entries of the HF-resonators. The partial air flow which is introduced into the HF-resonators 7, 8 through the exits and entries 21, 22 finally also flows through the exits 16, 17 into the combustion chamber 1 where a lower pressure PCC than in the burner plenum 14 obtains. An air flow which passes into the resonator 9 is therefore divided into three different partial air flows. Two partial air flows are passed to the HF-resonators 7, 8 whereas the third partial air flow is passed from the IF-resonator directly into the combustion chamber 1.

That manner of linking the resonators affords considerable advantages. The IF-resonators 9 for the medium frequency range require a considerably larger volume than the HF-resonators 7, 8 for the high frequency range. Overall the required structural volume can be optimised by suitable parallel and series connection of IF- and HF-resonators. In that respect preferably at least one resonator of the high frequency range and at least one resonator of the medium frequency range are integrated into the combustion chamber wall 3.

The pressure PCC prevailing in the combustion chamber 1 is about 3-6% lower than the pressure P3, that is to say the pressure reduction ΔP/P3 related to P3 is about 3-6%. That pressure reduction is divided into a pressure reduction of about 1-2.5% in the wall cooling passages (from P3 to P2) and a pressure reduction of about 2-3.5% in the air passages through the resonators (from P2 to PCC).

In an alternative configuration of the combustion chamber according to the invention the linking of the resonators for the high frequency range (HF-range) and the resonators for the medium frequency range (intermediate frequency) (IF-range) is such that it involves connection of the HF-resonator to the compressor plenum 13 at the pressure P3 and connection of the IF-resonator to the burner plenum 14 at the pressure P2. The ratio in respect of area and also volume between the HF-range and the IF-range can be freely selected in that case.

What is claimed is:

1. A combustion chamber for a gas turbine, formed of an outer combustion chamber wall and an inner combustion chamber wall, including a path for carrying a cooling fluid that flows between the inner and outer combustion chamber walls and has different pressure regions, the chamber also comprising:

a first acoustic resonator device connected to a portion of the inner combustion chamber wall having a first resonance frequency, the first device including one or more first flow inlets and two or more first flow outlets;

a second acoustic resonator device connected to a portion of the inner combustion chamber wall having a second resonance frequency, the second device including one or more second flow inlets and one or more second flow outlets, wherein a structure serves as both a first flow outlet of the first device and a second flow inlet of the second device so that at least one second flow inlet is positioned to receive fluid having passed through the first device, and wherein at least one second flow outlet of the second acoustic resonator device is positioned to pass cooling fluid into the combustion chamber, wherein cooling fluid at a first pressure flows into the first acoustic resonator device through at least one first flow inlet and out of the first acoustic resonator device through at least one of the first flow outlets, and wherein;

cooling fluid at a second pressure flows directly from the at least one first flow outlet into the second acoustic resonator device through the second flow inlet and out of the second acoustic resonator device through the second flow outlet;

and a second of the first flow outlets of the first acoustic resonator device is positioned to pass cooling fluid directly into the combustion chamber without first passing through another acoustic resonator device thereby providing at least two parallel flow paths.

2. The combustion chamber as claimed in claim 1, wherein the first resonance frequency is different than the second resonance frequency and the first pressure is different than the second pressure.

3. The combustion chamber claimed in claim 1, further including a third acoustic resonator device connected to a portion of the inner combustion chamber wall and including one or more third flow inlets and one or more third flow outlets, wherein a second structure serves as both a second of the first flow outlets of the first device and a third flow inlet of the third device so that at least one third flow inlet of the third device is positioned to receive flow having passed through the first device, and wherein at least one third flow outlet of the third device is positioned to pass cooling flow into the combustion chamber.

4. The combustion chamber claimed in claim 3, wherein a plurality of resonator devices are integrated into the inner combustion chamber wall and arranged so that a portion of the cooling flow may entirely pass through the first device and then partly through the second resonator device and into the combustion chamber and partly through a third acoustic resonator device having a different resonance frequency than the first device and into the combustion chamber.

5. The combustion chamber claimed in claim 4, wherein the resonator devices are adapted to allow partial flows of the cooling fluid to flow into each device through the flow inlet and out of each device through the flow outlet.

6. The combustion chamber claimed in claim 4, wherein the resonator devices are adapted to form parallel flow paths for the partial flows of the cooling fluid.

7. The combustion chamber claimed in claim 4, wherein the resonator devices are adapted to form flow paths that are connected in succession for the partial flows of the cooling fluid.

8. The combustion chamber claimed in claim 1, further comprising a main flow path for a main part of air flow to pass into the combustion chamber such that flow through the resonator devices is in parallel with flow through the main flow path.

9. The combustion chamber claimed in claim 4, wherein at least one acoustic resonator device has a first resonance frequency that functions as a high frequency damping device and at least one acoustic resonator device has a second resonance frequency that functions as a medium frequency damping device such that the second resonance frequency is less than the first resonance frequency.

* * * * *